United States Patent [19]

Bersch

[11] Patent Number: 5,072,476

[45] Date of Patent: Dec. 17, 1991

[54] APPARATUS FOR CLEANING PIPELINES FOR BEVERAGES AND THE LIKE

[76] Inventor: Friedrich Bersch, Industriestrasse 18, D-5401 Halsenbach, Fed. Rep. of Germany

[21] Appl. No.: 530,911

[22] Filed: May 30, 1990

[30] Foreign Application Priority Data

May 30, 1989 [DE] Fed. Rep. of Germany ..... 3917488

[51] Int. Cl.[5] ..... B08B 9/02

[52] U.S. Cl. ..... 15/3.51; 15/104.063

[58] Field of Search ..... 15/104.063, 3.51, 3.5; 134/169 C, 8

[56] References Cited

U.S. PATENT DOCUMENTS

| | | | |
|---|---|---|---|
| 2,621,668 | 12/1952 | Crispin | 134/169 C |
| 2,827,070 | 3/1958 | Gatz | 15/3.51 |
| 3,119,399 | 1/1964 | Bender | 134/169 C |
| 4,607,410 | 8/1986 | Bersch | 15/3.51 |
| 4,847,002 | 10/1989 | Sundholm | 134/169 C |
| 4,919,154 | 4/1990 | Engle | 134/169 C |

FOREIGN PATENT DOCUMENTS

| | | | |
|---|---|---|---|
| 1782136 | 5/1978 | Fed. Rep. of Germany | 15/3.51 |
| 3347003 | 12/1986 | Fed. Rep. of Germany . | |

*Primary Examiner*—Edward L. Roberts
*Attorney, Agent, or Firm*—Peter K. Kontler

[57] ABSTRACT

An apparatus for cleaning pipelines for beverages and other flowable media has a four-way shuttle valve with two ports which are connectable to the ends of a pipeline. The shuttle of the valve is movable in the valve body between a first position in which an inlet for a fresh liquid cleaning agent is free to admit cleaning agent to one of the ports while the other port discharges spent cleaning agent into an outlet of the body, and a second position in which the direction of flow of cleaning agent through the pipeline is reversed. Movements of the shuttle between its positions are initiated by one or more spherical cleaning elements which are inserted into the pipeline and travel from one of the ports toward the other port or in the opposite direction. In order to prevent jamming of the shuttle in the one or the other position, fresh cleaning agent is admitted into the inlet of the valve body by way of a shutoff valve which is alternatingly closed and opened at frequent intervals to ensure repeated rises of pressure of the cleaning agent so that the cleaning agent can overcome static friction between the shuttle and the body of the four-way valve.

9 Claims, 1 Drawing Sheet

APPARATUS FOR CLEANING PIPELINES FOR BEVERAGES AND THE LIKE

BACKGROUND OF THE INVENTION

The invention relates to improvements in apparatus for cleaning pipelines for beverages and the like. More particularly, the invention relates to improvements in apparatus of the type disclosed in commonly owned U.S. Pat. No. 4,607,410 and in commonly owned German Pat. No. 33 47 003.

Apparatus which are disclosed in the aforementioned patents employ a four-way shuttle valve wherein the valve body has an inlet for fresh liquid cleaning agent, an outlet for spent cleaning agent and two ports which are connectable with the ends of a pipeline to be cleaned. The valve body confines a reciprocable valving element in the form of a shuttle which is movable by the cleaning agent between a first position to connect the inlet for fresh cleaning agent with one of the ports while the other port communicates with the outlet so that the cleaning agent can flow from the inlet to the one port, through the pipeline and through the other port on to the outlet, and a second position in which the flow of cleaning agent is reversed, i.e., from the inlet to the other port, through the pipeline and through the one port on to the outlet. The means for reversing the direction of flow of cleaning agent, i.e., for initiating the movements of the shuttle between its two positions comprises one or more normally spherical cleaning elements, e.g., solid pearls or balls of sponge rubber or other material. The cleaning element or elements can obstruct the flow of fluid through passages (e.g., sets of holes) which are provided in the ends of the shuttle to thereby enable the cleaning agent to move the shuttle relative to the body of the shuttle valve.

The cleaning agent is tap water or another liquid, and such agent is supplied at a certain pressure in order to ensure that a stream of cleaning agent will flow from the inlet, through the pipeline and toward and into the outlet when the apparatus is in use. It is also known to employ a pump which supplies fresh liquid cleaning agent at a desired pressure. The diameter of the normally spherical cleaning element or elements can approximate the inner diameter of the pipeline to thus enhance the cleaning action when the cleaning element or elements are compelled to advance from one of the ports, through the pipeline and to the other port or in the opposite direction.

It has been found that the shuttle of the shuttle valve often fails to move from the one to the other position when the cleaning element or elements reach the one or the other port of the valve body. Attempts to reduce the likelihood of jamming of the shuttle in the one or the other position by reducing friction between the shuttle and the body of the valve have met with limited success. Failure of the shuttle to invariably move from the one to the other position in response to completed advancement of the cleaning element or elements from the one to the other end of the pipeline reduces the likelihood of predictable cleaning of the interior of the pipeline and entails losses in cleaning fluid because the apparatus must be operated for longer intervals of time if the number of reversals in the direction of flow of cleaning agent per unit of time is less than expected.

OBJECTS OF THE INVENTION

An object of the invention is to provide an apparatus which is constructed and assembled in such a way that the likelihood of jamming of the shuttle in the one or the other position is much less pronounced than in heretofore known apparatus.

Another object of the invention is to provide the apparatus with novel and improved means for preventing, or for reducing the likelihood of, jamming of the shuttle in the body of the shuttle valve.

A further object of the invention is to provide novel and improved means for controlling the flow of fresh cleaning agent into the inlet of the shuttle valve in the above outlined apparatus.

An additional object of the invention is to provide an apparatus which is capable of completing the cleaning of pipelines with savings in fresh cleaning agent.

Still another object of the invention is to provide a novel arrangement of valves for use in the above outlined apparatus.

A further object of the invention is to provide novel and improved means for supplying fresh cleaning agent to the shuttle valve of the above outlined apparatus.

An additional object of the invention is to provide a novel and improved method of enhancing the reliability of operation of the above outlined apparatus.

SUMMARY OF THE INVENTION

The invention is embodied in an apparatus for internally cleaning a pipeline having first and second ends with a liquid cleaning agent which conveys at least one cleaning element through the pipeline. The improved apparatus comprises a shuttle valve including a body or housing with an inlet for fresh cleaning agent, an outlet for spent cleaning agent, and first and second ports which are connectable with the respective ends of a pipeline to be cleaned. The valve further comprises a valving element (hereinafter called shuttle) which is movable in the body by cleaning agent between a first position in which the inlet and the outlet respectively communicate with the first and second ports (so that the cleaning agent can flow from the inlet, through the first port, through the pipeline in a direction from the first to the second end, and through the second port into the outlet of the body) and a second position in which the inlet and the outlet respectively communicate with the second and first ports (i.e., the direction of flow of cleaning agent through the pipeline is reversed). The apparatus further comprises means for intermittently supplying cleaning agent to the inlet.

In accordance with a presently preferred embodiment of the invention, the fluid supplying means comprises a shutoff valve, particularly a magnetic valve.

It is further preferred to provide the fluid supplying means with means (e.g., a timer) for intermittently closing and opening the shutoff valve. The timer and the shuttle valve can form a structural unit, i.e., they can be jointly installed in or removed from the apparatus. The timer can be designed to open the shutoff valve for relatively short intervals, e.g., at intervals of a few seconds. The arrangement may be such that the timer alternatingly opens and closes the shutoff valve for substantially identical intervals of time. Still further, the arrangement may be such that the timer repeatedly closes the normally open shutoff valve for relatively short intervals of time, e.g., for intervals in the range of up to five seconds.

The supplying means can further comprise a motor-driven pump or other means for conveying cleaning agent to the inlet of the body of the shuttle valve, and such apparatus can further comprise means (such as an electric switch) for setting the timer in operation (to start alternating opening and closing of the shutoff valve) jointly with the conveying means. The conveying means can also comprise a conduit which connects the inlet with a pipe for fresh water, and a faucet which can be opened in response to actuation of the switch at the time the switch is caused to set in operation the timer for the shutoff valve.

The shutoff valve can be secured to the shuttle valve; for example, the housing of the shutoff valve and the housing of the timer can be mounted on the body of the shuttle valve.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
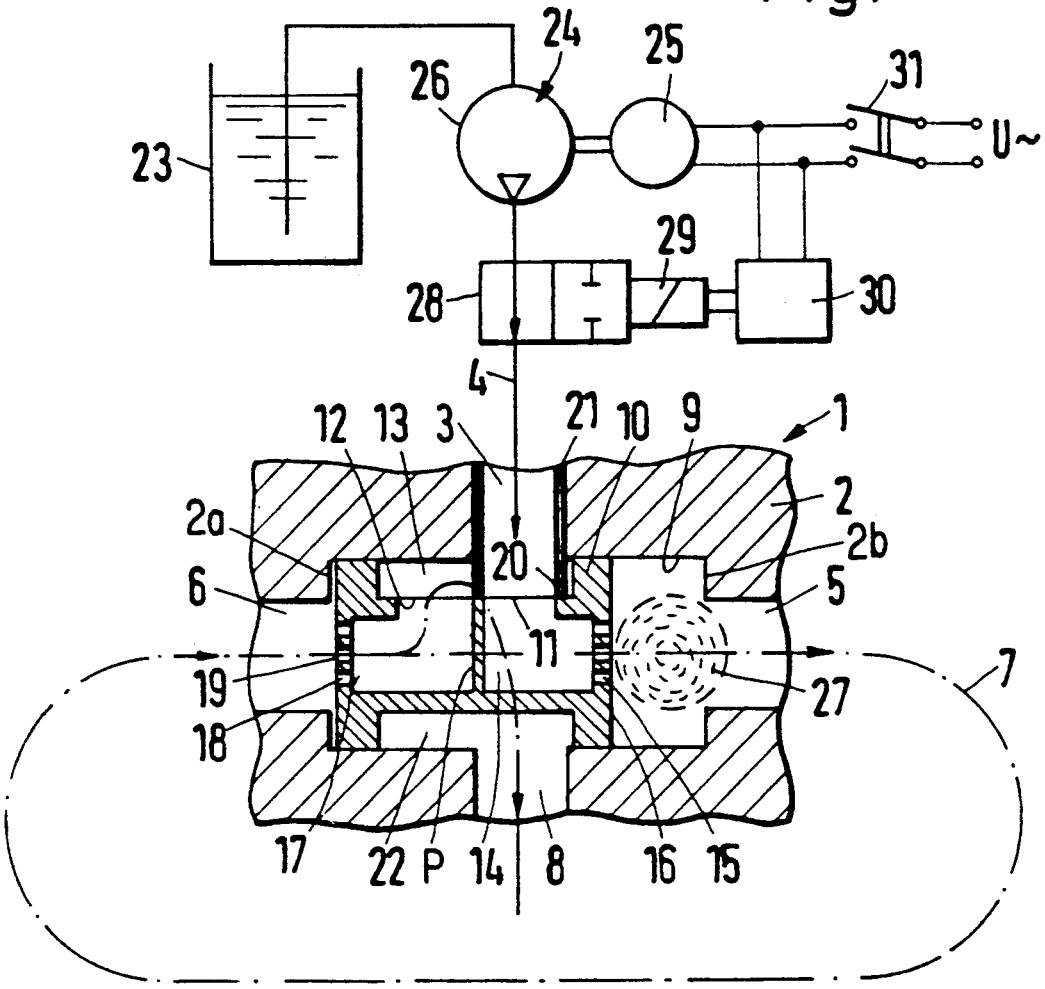
FIG. 1 is a schematic view of an apparatus which embodies one form of the invention, the shuttle valve being shown in section and partly broken away.

The apparatus which is shown in FIG. 1 comprises a four-way shuttle valve 1 having a housing or body 2 with an inlet 3 for fresh liquid cleaning agent (e.g., tap water), an outlet 8 for spent cleaning agent, a first port 5 which is connectable with one end of a pipeline 7 to be cleaned, and a second port 6 which is connectable with the other end of the pipeline. The body 2 defines an elongated chamber 9 which communicates with the ports 5, 6 and confines a reciprocable valving element or shuttle 10 having an internal space and a partition P dividing the internal space into two compartments 14, 17. The shuttle 10 is further provided with an axially parallel external groove 13 and with two openings 11, 12. The opening 11 is disposed between the compartment 14 and the groove 13, and the opening 12 is disposed between the groove 13 and the compartment 17. The openings 11 and 12 are disposed at opposite sides of the partition P. The shuttle 10 further comprises a first end wall 16 which confronts the port 5 and has a set of passages 15 in the form of axially parallel bores or holes. A second end wall 19 of the shuttle 10 confronts the port 6 and is provided with a set of passages in the form of axially parallel bores or holes 18.

The shuttle 10 is movable in the chamber 9 of the valve body 2 between the illustrated position in which the end wall 19 abuts an internal shoulder 2*a* of the body 2, the port 6 communicates with the outlet 8 by way of the passages 18, compartment 17, opening 12, axially parallel groove 13 and a circumferentially extending groove 22 of the shuttle, and a second position in which the end wall 16 abuts an internal shoulder 2*b* and the port 5 communicates with the outlet 8 by way of the passages 15, compartment 14, opening 11 and grooves 13, 22. When the shuttle 10 is held in the illustrated (first) position, the inlet 3 supplies fresh cleaning agent to the port 5 by way of the opening 11, compartment 14, passages 15 and a portion of the chamber 9; such cleaning agent flows from the port 5, through the pipeline 7, into the port 6 and thence into the outlet 8 by way of the passages 18, compartment 17, opening 12 and grooves 13, 22. The inlet 3 admits fresh cleaning agent to the port 6 when the shuttle 10 is moved to the other position (of abutment with the shoulder 2*b*) because the cleaning agent is then free to flow from the groove 13 into the passages 18 by way of the opening 12 and compartment 17. A nipple 21 in the inlet 3 seals the openings 11 and 12 from each other in either position of the shuttle 10; in addition, the nipple 21 prevents rotation of the shuttle 10 in the chamber 9 because it extends into the axially parallel external groove 13 of the shuttle.

The means for initiating movements of the shuttle 10 between its two positions includes one or more cleaning elements 27 (FIG. 1 shows a single ball-shaped cleaning element 27 which is located in the chamber 9 and at least partially seals at least some of the passages 15). Pressurized cleaning agent which is admitted by the inlet 3 acts upon the cleaning element 27 by way of the passages 15 so that the cleaning element is propelled into the pipeline 7 by way of the port 5 and cleans the internal surface of the pipeline on its way toward abutment with the end wall 19. At such time, the cleaning element 27 at least partially seals at least some of the ports 18 so that the pressure of cleaning agent in the port 6 rises and the cleaning agent shifts the shuttle from abutment with the internal shoulder 2*a* into abutment with the internal shoulder 2*b*. This establishes communication between the inlet 3 and the passages 18 so that the cleaning fluid propels the cleaning element 27 into the pipeline 7 via port 6 whereby the cleaning element sweeps along the internal surface of the pipeline on its way toward the end wall 16 to raise the pressure of cleaning fluid in the port 5 and to thus enable the pressurized cleaning agent to shift the shuttle 10 back to the illustrated position. The same procedure is repeated again and again as long as the inlet 3 admits fresh cleaning agent at a required pressure.

The means for supplying cleaning agent to the inlet 3 comprises a source 23 (e.g., a tank or another vessel), a fluid flow machine 24 including a pump 26 which can be driven by an electric motor 26 or by another suitable motor, and a conduit 4 which contains the pump 25 and extends from the source 23 to the nipple 21. The free end face 20 of the nipple 21 is adjacent or actually abuts the surface at the bottom of the axially parallel external groove 13 of the shuttle 10.

It has been found that, unless the pressure of fresh cleaning agent which is admitted into the inlet 3 is rather high or very high, the shuttle 10 is likely to remain (at times) in the one or the other position even if the pressure in the port 5 or 6 rises as a result of blocking of passages 15 or 18 by the cleaning element or elements 27. This is likely to reduce the cleaning action or to necessitate longer-lasting operation of the motor 25, i.e., longer-lasting admission of pressurized cleaning agent into the inlet 3. In accordance with the invention, the likelihood of jamming of the shuttle 10 in the one or the other position is greatly reduced or eliminated by the provision of a suitable shutoff valve 28 (e.g., a magnetic valve having a solenoid 29 serving to move the valving element of the valve 28 between open and closed positions) which is installed in the conduit 4 between the outlet of the pump 26 and the inlet 3 of the valve body 2. The means for alternatingly opening and closing the shutoff valve 28 comprises a timer 30 which is set in operation in response to closing of an electric double-pole on-off switch 31 in circuit with the electric motor 25, timer 30 and an energy source U.

The design and/or adjustment of the timer 30 can be such that the solenoid 29 is caused to alternatingly open and close the shutoff valve 28 for selected relatively short intervals of time as soon as the switch 31 is closed, i.e., as soon as the motor 25 causes the pump 26 of the fluid flow machine 24 to deliver a stream of fresh cleaning agent from the vessel 23 to the inlet 3 of the valve body 2. For example, the design of the timer 30 can be such that the valving element of the shutoff valve 28 is caused to assume an open position for an interval of 3–4 seconds, to thereupon assume a closed position for the same interval of time, to then assume an open position for the same interval of time, and so forth. However, it is equally possible to set the timer 30 in such a way that the intervals during which the shutoff valve 28 is open are longer than the intervals during which the shutoff valve is closed. Repeated opening and closing of the shutoff valve 28 entails alternating rises and drops of fluid pressure in the pipeline 7 with the result that the shuttle 10 is more likely to change its position as soon as the cleaning element or elements 27 reach the exposed side of the end wall 16 or 19.

Figure 2:
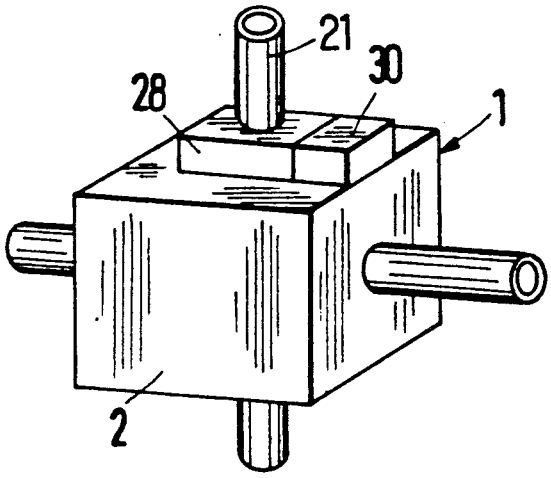
FIG. 2 is a perspective view of a presently preferred combination of shuttle valve and shutoff valve with timer.

FIG. 2 shows that the housings of the shutoff valve 28 and timer 30 can be assembled into a structural unit which is mounted on the body 2 of the shuttle valve 1 so that the valving element of the valve 28 can control the flow of fresh cleaning agent into the inlet 3 via nipple 21.

The improved apparatus is susceptible of many modifications without departing from the spirit of the invention. Thus, the means for intermittently supplying fresh cleaning agent to the inlet 3 of the valve body 2 can comprise a pipe, a hose or another conduit which is connectable to a source of tap water at normal pressure. Furthermore, the pump 26 can be designed to supply pressurized fresh cleaning agent in pulsating fashion. Still further, the passages 15, 18 need not be provided in the end walls of the shuttle 10 but rather in parts which are affixed to the shuttle. Shuttle valves which can be put to use in the improved apparatus are disclosed, for example, in the aforementioned commonly owned U.S. Pat. No. 4,607,410 and German Pat. No. 33 47 003 to which reference may be had, if necessary. Reference may also be had to commonly owned copending patent application Ser. No. 07/384,208 filed July 21, 1989, now U.S. Pat. No. 4,955,100 granted Sept. 11, 1990 and to commonly owned copending patent application Ser. No. 07/468,246 filed Jan. 19, 1990. Certain other types of four-way shuttle valves or analogous valves can be used with equal or similar advantage.

The shutoff valve 28 can be of the type known as 1.010 which is distributed by the firm A+K Müller, Düsseldorf, Federal Republic Germany. The timer 30 can be of the type known as MV-IS1 which is distributed by the firm Kristensen GmbH, Harrislee, Federal Republic Germany.

Numerous experiments with the improved apparatus indicate that the shuttle 10 is much less likely to jam in the one or the other position (of abutment with the internal shoulder 2*a* or 2*b*) by the simple expedient of causing the rate of admission of fresh cleaning agent to pulsate, i.e., by intermittently interrupting the admission of fresh cleaning agent to the inlet 3 of the valve body 2. The provision of a shutoff valve 28 or of analogous means for ensuring intermittent supplying of fresh cleaning agent to the inlet 3 is particularly important and desirable when the pipeline 7 which is to be cleaned exhibits a rather pronounced resistance to the flow of cleaning agent from the port 5 to the port 6 or in the opposite direction. The same holds true for apparatus which are provided with or are connectable with a source of fresh cleaning agent which is maintained at a relatively low pressure. The resistance which the cleaning agent encounters to the flow from the port 5 to the port 6 or in the opposite direction is likely to be quite pronounced if the pipeline contains or extends through a cooling unit and/or if the pipeline is long or very long. Furthermore, the pipeline is likely to offer pronounced resistance to the flow of a cleaning agent if it is used to convey nonalcoholic beverages; the inner diameter of such pipelines is normally in the range of 5 millimeters as compared with the inner diameters (approximately 7 millimeters) of pipelines which are used to convey beer, ale and like beverages. It is believed that, once a pipline to be cleaned offers a certain resistance to the flow of cleaning agent, the pressure in the port 5 or 6 (when such port is adjacent the end wall 16 or 19 and contains one or more cleaning elements 27) drops considerably so that such pressure does not suffice to initiate and effect a movement of the shuttle 10 from the shoulder 2*a* toward and into abutment with the shoulder 2*b* or in the opposite direction. However, if the apparatus employs the shutoff valve 28 or an equivalent of this valve, the pressure in the port which is immediately adjacent the respective end wall of the shuttle matches or at least closely approximates the pressure at the inlet 3, at least immediately subsequent to opening of the shutoff valve. This, in turn, ensures that the pressurized cleaning agent in the port 5 or 6 can overcome static friction between the shuttle 10 and the valve body 2 so that the shuttle begins to move in the chamber 9 from the one to the other position or vice versa. Once the static friction between the shuttle 10 and the valve body 2 is overcome, a relatively small pressure differential between the ports 5 and 6 suffices to ensure that the shuttle moves all the way from the one or the other position.

Another advantage of the shutoff valve 28 or of an analogous device for ensuring admission of pressurized fresh liquid cleaning agent at selected intervals is that the shutoff valve causes intermittent propulsion of one or more cleaning elements 27 through the pipeline 7 which is in the process of being cleaned. In other words, the distance which is covered by each cleaning element 27 in the pipeline 7 per unit of time is shorter than if the cleaning element or elements were in continuous motion. This causes the intermittently stagnant column of cleaning agent in the pipeline 7 to remain in longer-lasting contact with the adjacent portions of the pipeline, i.e., the periods of contact between the cleaning agent and the contaminants which coat the internal surface of the pipeline are longer with resulting more satisfactory cleaning or impurities-removing effect of the cleaning agent. The cleaning agent can contain one or more substances which are particularly effective in dissolving or otherwise separating contaminants from the internal surface of the pipeline, and such substances are even more effective if they are maintained in longer-lasting contact with the contaminants as a result of intermittent propagation of one or more cleaning elements 27 and of the column of cleaning agent through the pipeline. Still further, the apparatus uses up smaller quantities of fresh cleaning agent because each increment of the column of cleaning agent intermittently advancing between the ports 5 and 6 is in longer-lasting contact with the contaminant(s), if any, at the internal surface of the pipeline which is in the process of being cleaned, i.e., the intensity of cleaning action of each increment of such column of cleaning agent is more pronounced. In addition, repeated opening and closing of the shutoff valve 28 entails fluctuations or vibrations of the column of cleaning agent in the pipeline, and such vibrations also contribute to a more pronounced cleaning or sweeping action.

A magnetic shutoff valve is preferred at this time because such valves are compact and can be reliably opened and closed at frequent intervals. However, it is equally possible to employ other types of shutoff valves, for example, a manually operated shutoff valve. The person in charge simply observes the progress of the cleaning element or elements 27 in the pipeline 7 or the arrival of such cleaning element(s) at the port 5 or 6 to thereupon rapidly close and reopen the shutoff valve with the aforediscussed results, i.e., with greatly increased likelihood that the cleaning agent will overcome static friction between the shuttle 10 and the valve body 2 so that the shuttle is much more likely to move from its momentary position to the other position. It is equally possible to employ sensors which monitor the arrival of the cleaning element(s) 27 at the port 5 or 6 to generate signals which are used to rapidly close and reopen the shutoff valve 28, i.e., such sensors can be said to constitute a modified timer which replaces the illustrated timer 30. The utilization of a timer 30 which can repeatedly open and close the shutoff valve 28, even while the cleaning element or elements 27 are spaced apart from the port 5 or 6, is preferred at this time because repeated opening and closing of the valve 28 further enhances the cleaning action for the aforediscussed reasons, particularly due to vibratory movements of the column of liquid cleaning agent in the pipeline and due to longer-lasting contact between a certain quantity of cleaning agent and the impurities at the internal surface of the pipeline. In addition, repeated and frequent alternating opening and closing of the shutoff valve 28 even further reduces the likelihood of jamming of the shuttle 10 in the one or the other position within the chamber 9.

The assembly of the timer 30 and shutoff valve 28 into a structural unit simplifies and facilitates the installation of such unit in the improved apparatus. Mounting of the unit on the body 2 of the shuttle valve 2 also brings about certain advantages; for example, the conduit 4 need not carry the weight of the unit including the shutoff valve 28 and the timer 30.

It has been found that the influence of the unit including the shuttle valve 28 and the timer 30 upon the predictability of movements of the shuttle 10 between its two positions is particularly beneficial if the intervals during which the shutoff valve 28 is open are relatively short or very short, for example, in the range of 1-5 seconds. Intervals of seconds are particularly advantageous. Of course, the exact duration of intervals of maintaining the shutoff valve 28 in open position can vary to a certain extent for a number of reasons, such as the available pressure of fresh cleaning agent, the length and/or other parameters of the pipeline to be cleaned and/or others. The length of intervals during which the shutoff valve 28 remains open can equal or approximate the length of intervals of maintaining the valving element of the valve 28 in closed position. This has been found to contribute to thoroughness and reliability of the cleaning action. However, it is also possible to operate the shutoff valve 28 in such a way that the intervals during which this valve remains closed are shorter than the intervals during which pressurized cleaning agent is free to flow from the pump 26 into the inlet 3 of the valve body 2.

If desired, the timer 30 can be connected with an energy source (such as the source U in FIG. 1) independently of connection of the motor 25 with the same energy source or with another energy source. This renders it possible to start the timer 30 independently of the motor 25, i.e., the apparatus can be used to admit fresh cleaning agent to the inlet 3 without any interruptions while the timer 30 is inactive and the person in charge can thereupon start the timer if the shuttle 10 tends to jam in the one or the other position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for internally cleaning a pipeline having first and second ends with a liquid cleaning agent which conveys at least one cleaning element through the pipeline, comprising a shuttle valve including a body having an inlet for fresh cleaning agent, an outlet for spent cleaning agent, and first and second ports connectable with the respective ends of a pipeline to be cleaned, and a shuttle movable in said body by cleaning agent between a first position in which said inlet and said outlet respectively communicate with said first and second ports and a second position in which said inlet and said outlet respectively communicate with said second and first ports; means for intermittently supplying cleaning agent to said inlet, said supplying means comprising a shutoff valve; and means for intermittently closing and opening said shutoff valve.

2. The apparatus of claim 1, wherein said shutoff valve is a magnetic valve.

3. The apparatus of claim 1, wherein said closing and opening means comprises a timer.

4. The apparatus of claim 1, wherein said closing and opening means and said shuttle valve form a structural unit.

5. The apparatus of claim 1, wherein said closing and opening means includes means for opening said shutoff valve for intervals of a few seconds.

6. The apparatus of claimed 1, wherein said closing and opening means includes means for alternatingly closing and opening said shutoff valve for substantially identical intervals of time.

7. The apparatus of claim 1, wherein said closing and opening means includes means for closing said shutoff valve for short intervals of time.

8. The apparatus of claim 1, wherein said supplying means further comprises means for conveying cleaning agent to said inlet and further comprising means for setting said closing and opening means in operation jointly with said conveying means.

9. The apparatus of claim 1, wherein said shutoff valve is secured to said shuttle valve.

* * * * *